United States Patent [19]

Reeves

[11] Patent Number: 4,573,631

[45] Date of Patent: Mar. 4, 1986

[54] DISPOSABLE STRAW, LID AND CUP COMBINATION

[76] Inventor: Michael Reeves, 2299 Fountain Way East, #D, Costa Mesa, Calif. 92627

[21] Appl. No.: 623,703

[22] Filed: Jun. 22, 1984

[51] Int. Cl.[4] ..... B65D 1/00; B65D 25/38

[52] U.S. Cl. ..... 229/7 S; 220/90.2; 220/339; 229/1.5 B; 229/7 R; 229/44 R

[58] Field of Search ..... 220/90.2, 90.4, 90.6, 220/339; 215/1 A; 229/7 R, 7 S, 1.5 B, 44 R

[56] References Cited

U.S. PATENT DOCUMENTS

| | | | |
|---|---|---|---|
| 2,834,533 | 5/1958 | Carew | 229/1.5 B |
| 3,332,567 | 7/1967 | Pugh, Sr. | 220/90.2 X |
| 3,774,800 | 11/1973 | Lohwasser | 229/44 R X |
| 3,774,804 | 11/1973 | Henning | 229/7 S X |
| 3,921,889 | 11/1975 | Gibbons | 220/90.2 X |
| 4,043,478 | 8/1977 | Duncan | 220/90.2 |

*Primary Examiner*—Allan N. Shoap
*Attorney, Agent, or Firm*—Ben E. Lofstedt

[57] ABSTRACT

A combination straw, lid and cup including a cup, a lid forming a cover for the cup hinged at one end thereof, means for retaining the lid in an open position and against the body of the cup, an externally-mounted straw one end of which is passed through the bottom of the cup into the interior thereof and the other end extending above the rim of the cup, and a housing for the straw.

7 Claims, 4 Drawing Figures

DISPOSABLE STRAW, LID AND CUP COMBINATION

BACKGROUND OF THE INVENTION

1. Field of the Invention

The present invention relates to disposable cups for beverages, and more particularly, to disposable cups with integral lids and straws for sipping the beverage from the cup.

2. Description of the Prior Art

The prior art contains many examples of cups which include as an integral part of the cup, a straw. Typically, such integral straws are used for drinking or sipping unheated beverages. Straws are especially useful and convenient for use by small children and vehicle operators because the beverage can be consumed from the container without the necessity of raising the beverage cup to the person's lips and/or tilting the head. A straw used in such a fashion reduces the likelihood of the vehicle operator becoming involved in an auto accident because his or her eyes were forced to leave the roadway as the cup was tilted to consume the beverage contained therein.

The prior art devices of which the inventor is aware are:

U.S. Pat. Nos: 3,240,415; 3,332,567; 3,486,679; 3,558,033; 3,774,804; 4,043,478; 4,247,016 and German Pat. No. 2,621,121.

U.S. Pat. No. 3,240,415 relates to a drinking cup with a straw incorporated therein. In this particular design, the straw 42 is mounted to the lid 22 with its lower portion extending downwardly to a point near the bottom 14 of the cup 12. A cover piece 50 is secured to the lid 22 in order to cover the straw portion mounted in the lid 22 in order to maintain the prior-to-use sanitary condition of the straw 42.

U.S. Pat. No. 3,332,567 relates to a container 14 with an exteriorly-mounted straw 28. In order to consume the beverage contents of the container 14, the straw 28 must be removed from its mounting and thereafterwards placed in the container for use.

U.S. Pat. No. 3,486,679 relates to a disposable beverage container 21 with a built-in sipping tube or straw 38. The tube 38 is mounted within the container 21. The upper portion of the tube 38 is secured to a removable portion 40 of the lid 29.

U.S. Pat. No. 3,558,033 relates to a disposable drinking cup 11 which incorporates a straw 20 mounted on the inside of the cup 11.

U.S. Pat. No. 3,774,804 relates to a straw-forming structure for beverage containers 12. The straw 22 is mounted externally, and, once the cup 12 is formed, a device is provided for opening the collapsed straw 22 for use.

U.S. Pat. No. 4,043,478 relates to a beverage container 12 incorporating an integral straw 21. The externally arranged portion of the straw 21 is kept in a sanitary condition by a lid 13 which is hinged at 17 to the rim of the cup 12 and functionally maintained to the side of the cup 12 by projections 14 on the cup's sidewall.

U.S. Pat. No. 4,247,016 relates to a lid-straw combination for a disposable cup 11, wherein the straw 30 is arranged to be nested in the lid 21 of the cup. A hinged lid 21 is not provided in this particular arrangement.

German Pat. No. 2,621,121 relates to a disposable cup and hinged lid 20 combination which includes a centrally-arranged self-closing aperture 8 for passing a straw 71 therethrough for drinking.

All of the above combinations have one or more disadvantages including, but not limited thereto, the following:

1. Straws mounted on the interior of the cup;
2. Unhinged lids;
3. Straws mounted to the lid;
4. Cups and straws cannot be nested or stack vertically;
5. Not adapted for use without the integral straw should that be desired;
6. Not structurally stiff to prevent ease of container collapse when side-loaded;
7. No means to prevent premature and undesired beverage flow through the straw prior to desired use;
8. Not a fully integrated combination lid, cup and straw so that when disposed of following consumption of the beverage, the entire combination is disposed of together, in combination.

SUMMARY OF THE INVENTION AND OBJECTS

Fundamentally, the present invention consists of a combination straw, lid and cup including a cup, a lid forming a cover for the cup hinged at one end thereof, means for retaining the lid in an open position and against the body of the cup, an externally-mounted straw one end of which is passed through the bottom of the cup into the interior thereof and the other end extending above the rim of the cup, and a housing for the straw.

It is one object of the instant invention to provide a combination cup, lid and straw which is "nestable" or stackable with other similarly-constructed combination cup, lid and straw.

Another object of the present invention is to provide a combination structure of the type disclosed herein with a hinged lid with a means for retaining the lid in its open position and secured against the body of the cup.

A yet still further object of the invention is to provide a unique and convenient combination "all in one" utensil for containing and consuming beverages.

One object of the invention is to provide a means for eliminating the need for purchasing separate items, such as straws and lids, for use with the beverage carrying cup.

Another object of the present invention is to eliminate the problems associated with the need to separately dispose of, or trash, separate items.

A yet still further object of the present invention disclosed and described herein is to provide a means for eliminating the handling of separate items, thereby reducing the likelihood of an unsanitary item.

Another object of the instant invention is to provide an integral combination cup, lid and straw which is spill-proof.

One object of the invention is to provide an integral combination which is safe because it is formed into a single, unitary combination useable in and around zoos where separate straws and lids might be dangerous to use if eaten by the animals.

Another object of the invention is to provide an attached lid for the cup which keeps drinks colder and fresher for a longer period of time.

An object of the present unique combination cup, lid and straw is to eliminate the need for a separate, and disposable, sanitary wrapper for the straw which can be shot by children blowing into the straws.

These together with other objects and advantages which will become subsequently apparent reside in the details of construction and operation as more fully hereinafter described and claimed, reference being had to the accompanying drawings forming a part hereof, wherein like numerals refer to like parts throughout, and in which:

DESCRIPTION OF THE PREFERRED EMBODIMENT

Figure 1:
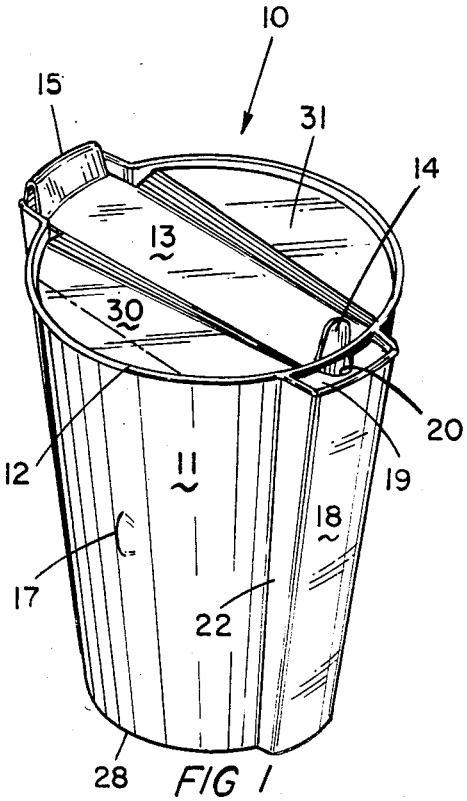
FIG. 1 is a perspective view of the present invention with the lid and the straw cover closed with respect to the cup.
Figure 2:
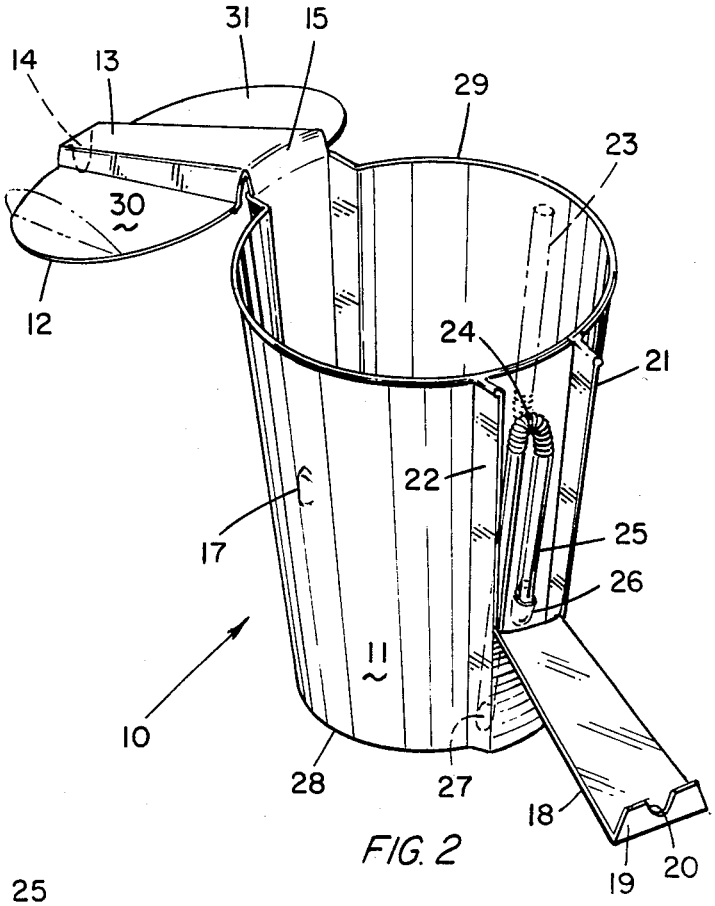
FIG. 2 is a perspective view of the present invention with the lid and the straw cover open with respect to the cup.
Figure 4:
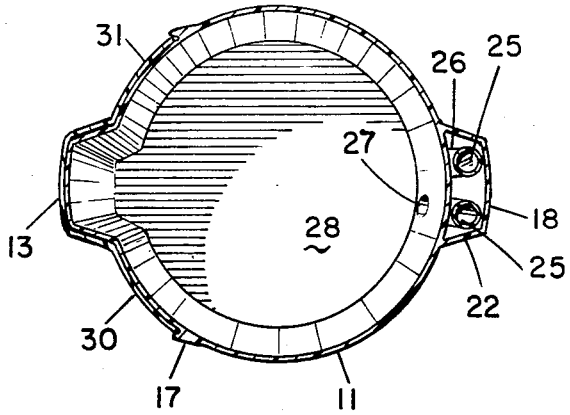
FIG. 4 is a view of the instant invention taken along Plane 4—4 of FIG. 3.

With continued reference to the drawings herein, there is shown and described a combination straw, cup and lid, generally identified at 10 in FIGS. 1 and 2.

The cup 11 includes a rim 29 and a bottom 28.

A lid 31 for the cup 11 includes a trough 13 with a pull-tab 14 at one end and a hinged 15 which is operably secured to the cup 11. The lid 31 is arranged so that it is slightly larger in diameter than the entrance to the cup 11 generally defined by the rim 12 of the cup 11. The outer peripheral contour 12 of the lid 31 is shaped in conforming complementary fashion to the opening, via the rim 29, to the cup 11. The purpose of this particular arrangement will become increasingly clear as the description of the invention proceeds further hereinafterwards.

Disposed directly beneath the hinge 15 and the trough 13 of the lid 31, is a similar trough (unnumbered) which extends from the rim 29 to the bottom 28 of the cup 11. The purpose of this trough on the sidewall of the cup 11 is to provide for improved sidewall rigidity of the cup 11 when the cup 11 is formed generally of a relatively thin-walled substance such as plastic or an appropriate metal, such as aluminum. Also, this trough allows the sidewall of the cup 11 to be springly compliant as the lid 31 is forced into its retained position to cover the opening of the cup 11. As the lid 31 is manually forced into releaseably lockable engagement with the cup 11 near the rim 29 of the cup 11, the trough 13 is allowed to move, and due to the spring memory inherent in the plastic material of which the disposable cup combination 10 is typically constructed of, a close, leak-proof fluid seal is effectuated between the outer perphery 12 of the lid 31 and the cup's sidewall near the rim 29.

On the side of the cup 11 opposite to the trough on the sidewall of the cup 11 which extends from the rim 29 to the bottom 28 of the cup 11 is a straw 25 and a cover 18 for the straw 25.

The straw 25 has one end 27 extending into the bottom 28 of the cup 11 via a hole in the sidewall of the cup 11. This permits the straw 25 to communicate with the fluid or beverage in the cup 11. The straw 25 has a plurality of corrugations about the mid-body thereof to provide a means for flexing the straw 25 without flattening or breaking the straw 25. A mounting post 26 for the end of the straw 25 is provided to retain the end of the straw 25 in a relatively fixed position and to prevent any fluid or beverage in the container or cup 11 from running out of the straw 25 should the cup 11 be tilted or dropped with a beverage therein.

A straw cover 18 is provided which is hinged mediately along its longitudinal axis. A pair of substantially parallel sidewalls 21, 22 sealingly secured to the sidewall of the cup 11 and running from the rim 29 of the cup 11 to the bottom 28 of the cup 11 are provided to complete the formation of an enclosure for the externally-mounted straw 25 in conjunction with the straw cover 18. The longitudinal edges of the cover 18 sealingly engage with the outermost longitudinal edges of the sidewalls 21, 22 when the straw cover 18 is brought into close proximity therewith. The upper lip 19 of the straw cover 18 is lockably engageable with the upper portions of the sidewalls 21, 22 and the cup's rim 29 to retain the straw cover 18 in its straw covering or protective position prior to the use of the straw 25. A notch 20 is provided for clearance between the straw 25 and the lip when the straw 25 is raised to its fully extended position for use.

USE OF THE INVENTION

After a fluid or a beverage is poured into the cup 11, the lid 31 is positioned in its "closed" or "shut" position as shown and illustrated in FIG. 1.

Figure 3:
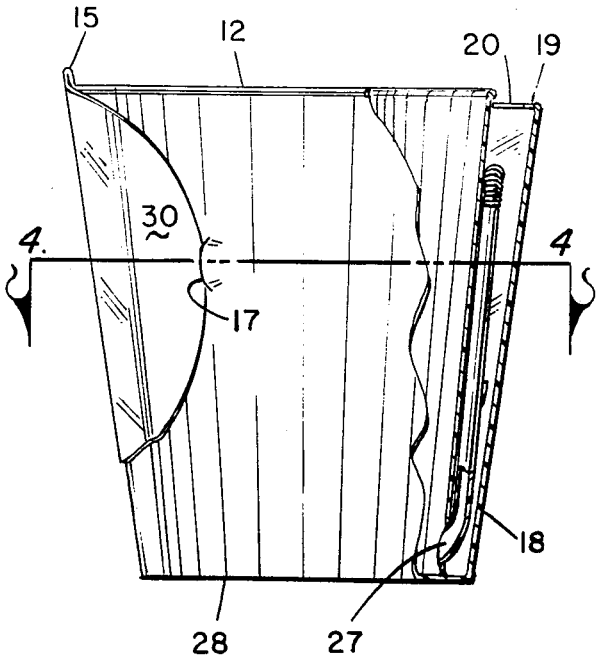
FIG. 3 is a side elevational view partially in section of the present invention with the lid shown in its open and retained position with respect to the cup and the straw cover closed.

In order to drink the beverage contained in the cup 11 without the use of the straw 25, the lid 31 is manually pulled via the pull-tab 14 from its closed position in FIG. 1 to an intermediate position as shown in FIG. 2. To lock the lid 31 along side the sidewall of the cup 11, the outer peripheral contour 12 is brought into releasably lockable engagement with a pair of locking shoulders 17 which are mounted on either side of the cup's sidewall, in complementary fashion, intermediately thereof. Again, the spring-memory of the resilient plastic material, coupled with the trough 13 allows the lid 31 to be retained in position near the sidewall of the cup 11 as shown in FIG. 3 presenting the cup 11 with the beverage therein for drinking.

In the event that the use of the straw 25 should be desired, the straw cover 18 is disengaged from its locked position as shown in FIG. 1 to its open position as shown in FIG. 2. The straw 25 is disengaged from its mounting post 26 and placed in its upright position 23 as depicted in phantom lines in FIG. 2. The user may now use the straw 25 as beverage is suctioned from the bottom of the cup 11 via the other straw end 27.

It is quite clear from the shape and contour of the presently disclosed preferred embodiment of the invention that a plurality of cups 11 can be nestably stacked and easily disengageable from one another following engagement. This is the purpose of the tapered sidewalls of the cup 11 and the shape of the troughs.

While there has been described above the principles of this invention in connection with specific apparatus, it is to be clearly understood that this description is made only by way of example and not as a limitation in the scope of the invention.

What is claimed is:

1. An improved cup, lid and straw combination, comprising:

(a) a cup having a generally tapered sidewall with a closed bottom and an open top portion, one portion of said sidewall having an outwardly-radiating trough extending from the top to the bottom of said cup, and an outwardly radiating sanitary enclosure extending from the top of the cup to the bottom, said enclosure having a cover hinged intermediate the enclosure, the exterior shape of said enclosure being substantially the same shape as the cup's trough, with an aperture in the bottom of the sidewall of the cup opening into the sanitary enclosure;

(b) a lid, said lid including a trough section therein, one end of said trough having a manual pull-tab thereon, the opposite end of said trough having a hinge thereon, said hinge being operably secured to the top of said trough in said sidewall of said cup; and (c) a straw having a flexible portion therein, one end of said straw being mounted in said sidewall through the aperture therein, and the balance of said straw being operably arranged for containment within said sanitary enclosure.

2. The improved combination of claim 1, further comprising means for retaining the lid in an open position.

3. The improved combination of claim 2, further comprising means for securing the lid in an open position and against the sidewall of the cup.

4. The improved combination of claim 3, wherein said means for securing the lid in an open position and against the sidewall of the cup, comprises:

(a) a first locking shoulder disposed on the outside of said cup sidewall in operable alignment with a portion of the rim of said lid; and (b) a second locking shoulder disposed on the outside of said cup sidewall in oppositely-disposed operable alignment with a portion of the rim of said lid, said portion being oppositely-disposed to said first locking shoulder, whereby when said lid is releaseably disengaged from the top of said cup and brought into intimate juxtaposition with said cup sidewall, a pair of sections of the rim of the lid are caused to come into releasably lockable engagement with said pair of locking shoulders.

5. The combination of claim 1 wherein said combination is formed of plastic material.

6. The combination of claim 1 wherein said combination further includes a mounting post on said sidewall within said sanitary enclosure whereupon the open free end of the straw may be engaged for mounting purposes.

7. The combination of claim 1 further including spring means incorporated in said lid for biasing the rim portion of said lid into intimate, fluid sealing engagement with the inside top portion of said cup sidewall.

* * * * *